US009518584B2

(12) United States Patent
Chen et al.

(10) Patent No.: US 9,518,584 B2
(45) Date of Patent: Dec. 13, 2016

(54) CENTRIFUGAL FAN WITH ANCILLARY AIRFLOW OPENING

(71) Applicants: Wen-Cheng Chen, New Taipei (TW); Chih-Jen Liu, New Taipei (TW)

(72) Inventors: Wen-Cheng Chen, New Taipei (TW); Chih-Jen Liu, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 911 days.

(21) Appl. No.: 13/666,889

(22) Filed: Nov. 1, 2012

(65) Prior Publication Data

US 2014/0099197 A1 Apr. 10, 2014

(30) Foreign Application Priority Data

Oct. 8, 2012 (TW) ..... 101137119 A

(51) Int. Cl.
*F04D 17/16* (2006.01)
*F04D 29/42* (2006.01)
*F04D 25/06* (2006.01)

(52) U.S. Cl.
CPC ..... *F04D 17/162* (2013.01); *F04D 25/0613* (2013.01); *F04D 29/4226* (2013.01)

(58) Field of Classification Search
CPC . F04D 17/162; F04D 25/0613; F04D 29/4226
See application file for complete search history.

(56) References Cited

U.S. PATENT DOCUMENTS 7,802,617 B2 * 9/2010 Hwang ..... F04D 29/422 165/122
2006/0024160 A1 * 2/2006 Horng ..... F04D 29/4226 415/206
2012/0288384 A1 * 11/2012 Chou ..... F04D 17/162 417/410.1
2013/0071238 A1 * 3/2013 Lu ..... H05K 7/20172 415/203

FOREIGN PATENT DOCUMENTS

TW 201014980 4/2010

* cited by examiner

*Primary Examiner* — Christopher Verdier
*Assistant Examiner* — Brian O Peters
(74) *Attorney, Agent, or Firm* — Zhigang Ma

(57) ABSTRACT

An exemplary centrifugal fan includes a housing and an impeller received in the housing. The housing defines an air inlet and an air outlet thereof. Airflow driven by the impeller flows out of the housing via the air outlet. The housing further defines an opening adjacent to one end of the air outlet. The ambient air out of the centrifugal fan enters the housing via the opening, and flows out of the housing via the air outlet.

13 Claims, 4 Drawing Sheets

CENTRIFUGAL FAN WITH ANCILLARY AIRFLOW OPENING

BACKGROUND

1. Technical Field

The present disclosure relates to centrifugal fans typically used in electronic devices such as computers.

2. Description of Related Art

With rapid development of the computer industry, central processing units (CPUs) in computers generate a large amount of heat during operation, and the heat must be dissipated immediately. A typical heat dissipation device for dissipating heat from a CPU includes a centrifugal fan and a heat sink. A cooling airflow generating by the centrifugal fan dissipates the heat rapidly, so that heat remaining in the CPU stays within a safe temperature range.

One way to improve the heat dissipation performance of the centrifugal fan is to increase the rotation rate of the blades, thereby increasing the air output of the centrifugal fan. However, this may also increase the noise of the centrifugal fan, and annoy or discomfort the user of the computer.

Therefore, a centrifugal fan which is capable of overcoming the above described shortcomings is desired.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
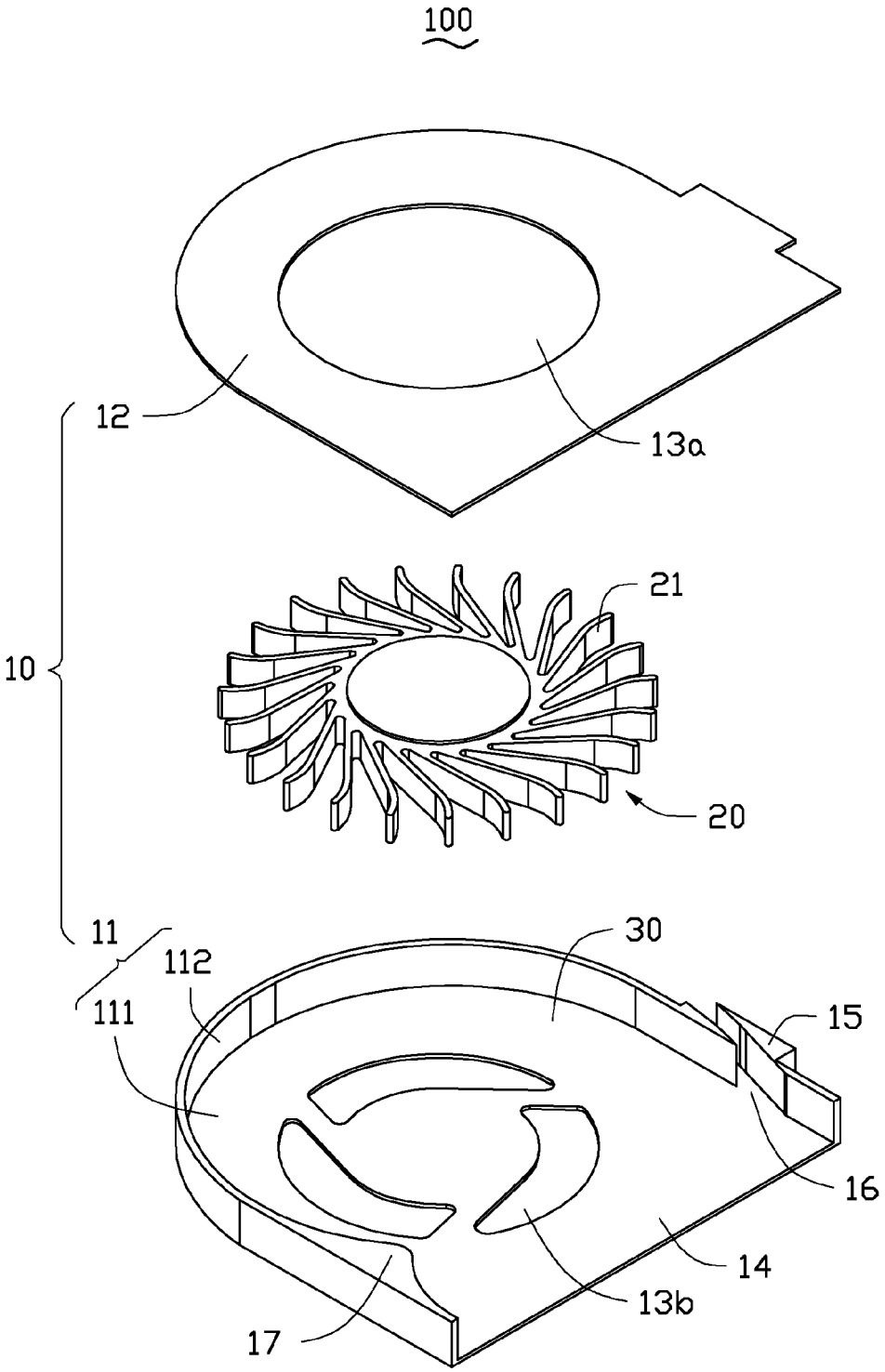
FIG. 1 is an exploded, isometric view of a centrifugal fan in accordance with a first embodiment of the present disclosure.

Referring to FIG. 1, a centrifugal fan 100 of a first embodiment of the present disclosure includes a housing 10 and an impeller 20. The housing 10 defines a receiving room 30, and the impeller 20 is received in the receiving room 30. The impeller 20 has a plurality of blades 21.

The housing 10 includes a base 11, and a top plate 12 covering the base 11. The base 11 includes a bottom plate 111, and a peripheral sidewall 112 perpendicularly and upwardly extending from a periphery of the bottom plate 111. The top plate 12 connects a top end of the sidewall 112, and is parallel to the bottom plate 111. An air inlet 13*a* is defined in a center portion of the top plate 12, and an air inlet 13*b* is defined in a corresponding center portion of the bottom plate 111, with both air inlets 13*a*, 13*b* corresponding to a position of the impeller 20. In the illustrated embodiment, the air inlet 13*a* is different from the air inlet 13*b*. In particular, the air inlet 13*a* is a round hole, and the air inlet 13*b* comprises three discrete, elongated, curved cutouts arranged in a circle radially symmetrically. An air outlet 14 is defined in one side of the sidewall 112. An orientation of an opening of the air outlet 14 is substantially perpendicular to an orientation of an opening of each of the air inlets 13*a*, 13*b*. The air outlet 14 is communicated with the air inlets 13*a*, 13*b* via an interior of the housing 10, i.e., the receiving room 30.

In operation of the centrifugal fan 100, the blades 21 of the rotating impeller 20 drive air to flow along an inner surface of the sidewall 112 and then towards the air outlet 14 of the centrifugal fan 100. A bulge 17 is formed on the inner surface of the sidewall 112 close to one end of the air outlet 14. The bulge 17 extends into the interior of the housing 10. The bulge 17 is used for increasing air pressure of the air flowing into the housing 10 from the air inlets 13*a*, 13*b*.

A protrusion 15 is formed on an outer surface of the sidewall 112 close to the other end of the air outlet 14. The protrusion 15 extends outwards away from the housing 10. The protrusion 15 is integrally formed with the sidewall 112 as a single piece. In fact, in the present embodiment, the entire base 11 is a single monolithic body made of the one same material. An oblique opening 16 is defined commonly through the protrusion 15 and the sidewall 112, and communicates with the external environment of the base 11. The opening 16 extends obliquely from an outer surface of the protrusion 15 to the inner surface of the sidewall 112, along a direction substantially consistent with a clockwise direction of rotation of the impeller 20. In particular, outer extremities of the blades 21 cooperatively define an imaginary circle, and the direction of rotation of the impeller 20 can be considered to coincide with such circle. A tangent can be drawn on the circle at a point thereof nearest to a middle of the opening 16. The direction of extension of the opening 16 is parallel to or approximately parallel to such tangent. With this configuration, a user of the centrifugal fan 100 cannot see the internal structure of the centrifugal fan 100 from the exterior of the centrifugal fan 100, and so the internal structure of the centrifugal fan 100 does not adversely affect the aesthetic appearance of the centrifugal fan 100. In addition, the protrusion 15 can enhance the strength of the sidewall 112 at the opening 16, and help avoid breakage of the sidewall 12 due to the presence of the opening 16.

During operation of the centrifugal fan 100, the impeller 20 rotates clockwise. The blades 21 drive air to flow into the interior of the housing 10 from the air inlets 13*a*, 13*b*; and the air then passes along the inner surface of the sidewall 112, and flows towards the air outlet 14. Due to the configuration of the bulge 17, and due to flaring of the airflow path as the air flows finally away from the blades 21 and towards the air outlet 14, the air pressure at the air outlet 14 is reduced. The means that the airflow accelerates as it passes out of the air outlet 14, and also that the air pressure at the air outlet 14 is lower than the air pressure outside the housing 10 where the opening 16 is located. According to the principle that air flows from areas with high air pressure to areas with low air pressure, the air outside the housing 10 at the opening 16 flows into the housing 10 through the opening 16, and then flows out from the air outlet 14 together with the original airflow generated by the blades 21.

Therefore, firstly, the air output of the centrifugal fan 100 is increased due to the additional airflow generated by the air pressure difference at the opening 16, and the heat dissipation performance of the centrifugal fan 100 is improved without any need to increase the rotation rate of the blades 21. Secondly, the airflow generated by the air pressure difference at the opening 16 flows from outside the housing 10 through the opening 16, and thereby dissipates heat generated by electronic components located close to the opening 16. Thirdly, the opening 16 extends obliquely in the protrusion 15, along a direction substantially consistent with the rotation direction of the impeller 20. This means the airflow generated by the air pressure difference at the opening 16 flows out from the air outlet 14 substantially without changing the direction of the original airflow generated by the blades 21, i.e., with minimum or no interference caused to the original airflow. Therefore the noise (if any) of the centrifugal fan 100 is not raised by the provision of the opening 16.

Figure 2:
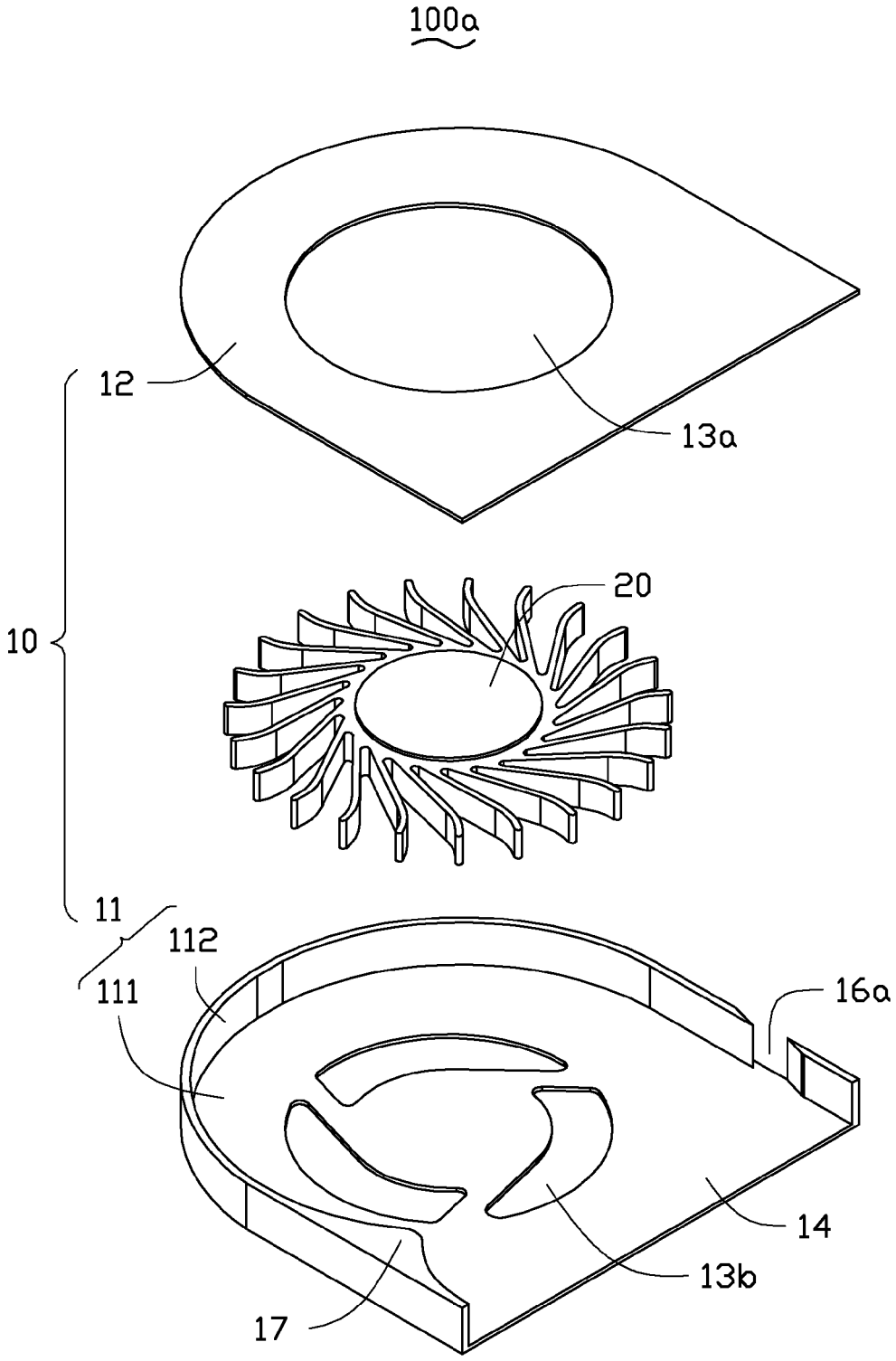
FIG. 2 is an exploded, isometric view of a centrifugal fan in accordance with a second embodiment of the present disclosure.

Referring to FIG. 2, a centrifugal fan 100*a* of a second embodiment of the present disclosure is shown. Compared with the centrifugal fan 100 of the first embodiment, no protrusion 15 is formed on the sidewall 112 of the centrifugal fan 100*a*, and instead an opening 16*a* is directly defined in the sidewall 112. The opening 16*a* extends obliquely from the outer surface of the sidewall 112 to the inner surface of the sidewall 112 along a direction toward the air outlet 14. The centrifugal fan 100*a* has characteristics similar to those of the centrifugal fan 100, and functions in a manner similar to that of the centrifugal fan 100.

Figure 3:
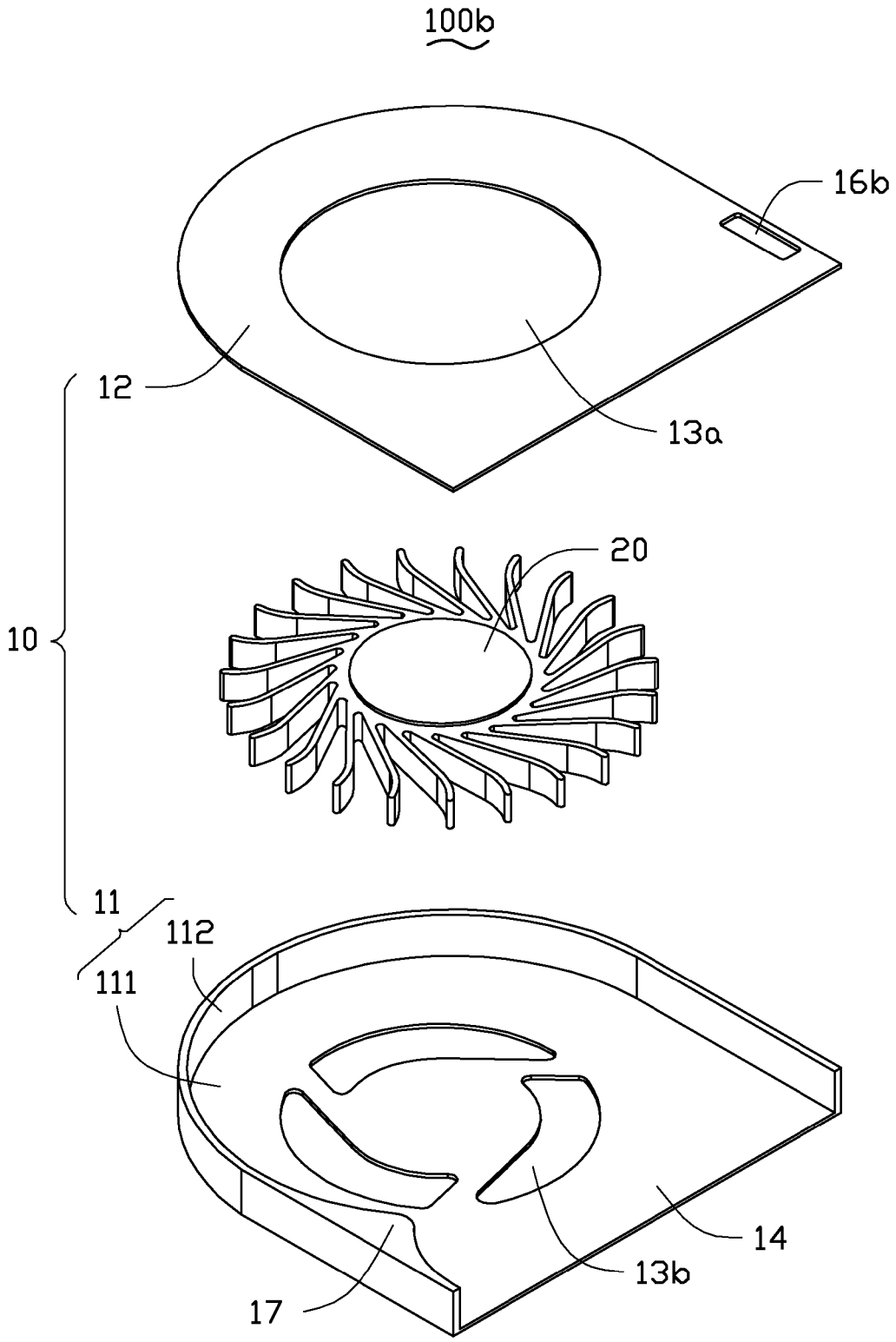
FIG. 3 is an exploded, isometric view of a centrifugal fan in accordance with a third embodiment of the present disclosure.
Figure 4:
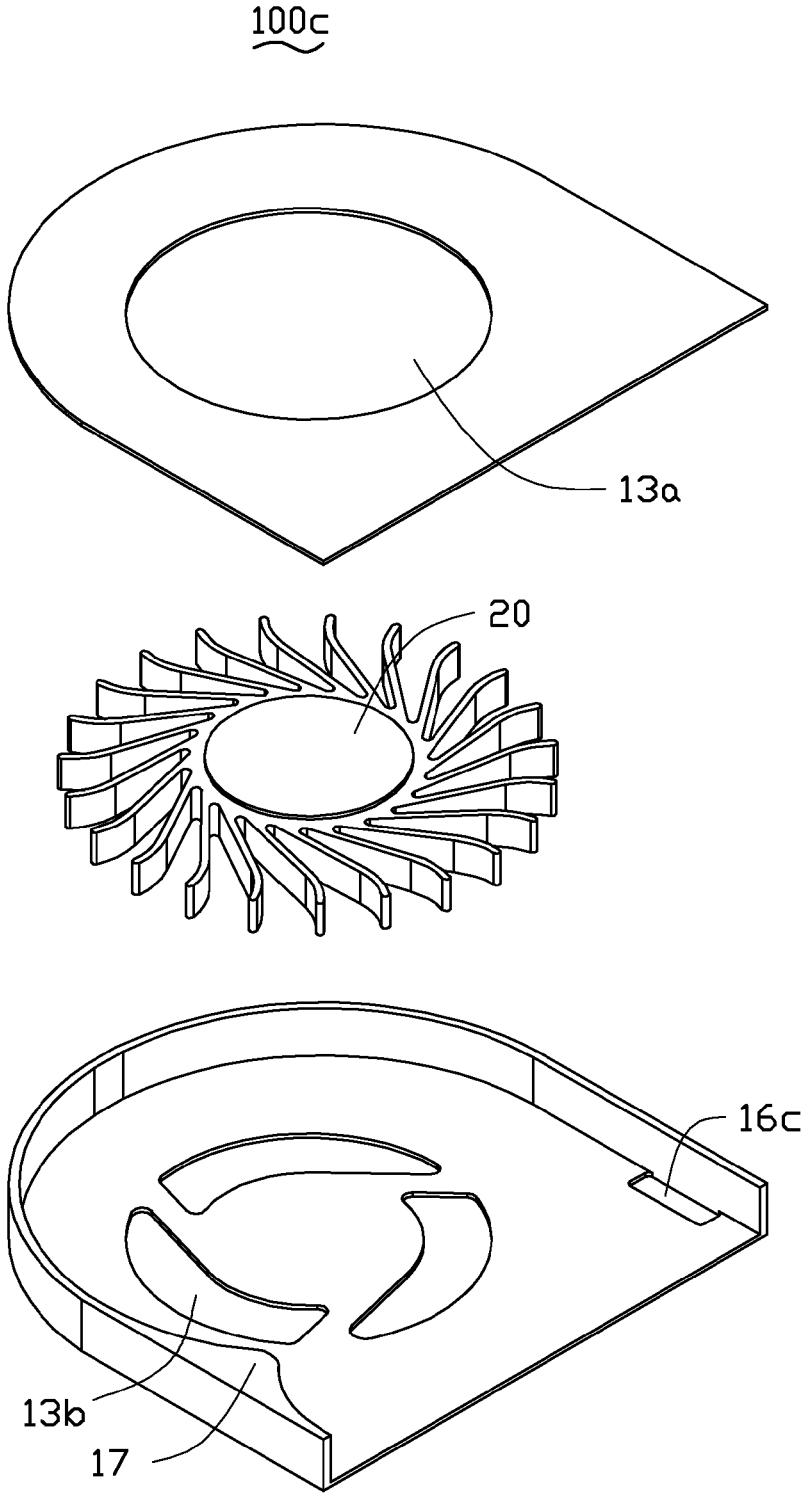
FIG. 4 is an exploded, isometric view of a centrifugal fan in accordance with a fourth embodiment of the present disclosure.

Referring to FIGS. 3 and 4, centrifugal fans 100*b* and 100*c* of third and fourth embodiments of the present disclosure are shown. The centrifugal fans 100*b* and 100*c* are both similar to the centrifugal fan 100*a*. The differences are, a rectangular opening 16*b* of the centrifugal fan 100*b* is defined in the top plate 12, close to the air outlet 14 and the sidewall 112. There is no opening defined in the sidewall 112. A rectangular opening 16*c* of the centrifugal fan 100*c* is defined in the bottom plate 111, close to the air outlet 14 and the sidewall 112. There is no opening defined in the sidewall 112. The centrifugal fans 100*b*, 100*c* each have characteristics similar to those of the centrifugal fan 100, and function in a manner similar to that of the centrifugal fan 100.

It is understood that the shapes and/or quantities of the openings 16, 16*a*, 16*b*, 16*c* and the specific structures of the centrifugal fans 100, 100*a*, 100*b*, 100*c* are not limited to what is described above and shown in the drawings. Such shapes, quantities and/or specific structures can be altered, adjusted, combined and/or omitted according to actual requirements.

In addition, the particular embodiments shown and described are provided by way of illustration only. The principles and the features of the present disclosure may be employed in various and numerous embodiments without departing from the scope of the disclosure. The above-described embodiments illustrate the scope of the disclosure but do not restrict the scope of the disclosure.

What is claimed is:

1. A centrifugal fan comprising:

a housing, the housing defining an air inlet, an air outlet, and an opening adjacent to but separate from one end of the air outlet, the housing comprising a base, the base comprising a bottom plate and a sidewall upwardly extending from a periphery of the bottom plate; and an impeller received in the housing, air driven by the impeller flowing out of the housing via the air outlet;

wherein the opening penetrates through the sidewall of the base and communicates with the external environment of the housing, ambient air outside the housing enters the housing via the opening and flows out of the housing via the air outlet;

wherein the housing further comprises a top plate covering the base, and the top plate connects a top end of the sidewall;

wherein the housing defines another air inlet making a total of two air inlets, one of the air inlets is defined in a center portion of the top plate, and the other air inlet is defined in a corresponding center portion of the bottom plate, with both air inlets corresponding to a position of the impeller;

wherein an inner surface of the sidewall forms a bulge close to the other end of the air outlet, the bulge extending towards an interior of the housing; and wherein an outer surface of the sidewall forms a protrusion close to the end of the air outlet, the protrusion extends outwards away from the housing, and the opening extends from an outer surface of the protrusion to the inner surface of the sidewall, in a direction towards the air outlet.

2. The centrifugal fan of claim 1 wherein the opening is defined in the sidewall and communicates with the air outlet via the interior of the housing, the bulge contributes to the air outlet having a lower air pressure than the air pressure at each of the air inlets, and ambient air outside the housing at the opening has a higher air pressure than the air pressure at the air outlet.

3. The centrifugal fan of claim 2, wherein the opening extends obliquely from an outer surface of the sidewall to the inner surface of the sidewall along a direction substantially consistent with a direction of rotation of the impeller as defined at a point of the impeller nearest to a middle of the opening.

4. The centrifugal fan of claim 1, wherein the opening extends obliquely along a direction substantially consistent with a direction of rotation of the impeller as defined at a point of the impeller nearest to a middle of the opening.

5. The centrifugal fan of claim 1, wherein the protrusion is integrally formed with the sidewall as a single piece.

6. The centrifugal fan of claim 5, wherein the opening extends obliquely along a direction substantially consistent with a direction of rotation of the impeller as defined at a point of the impeller nearest to a middle of the opening.

7. The centrifugal fan of claim 1, wherein the opening is defined from the bottom plate and communicates with the air outlet via the interior of the housing, the bulge contributes to the air outlet having a lower air pressure than the air pressure at each of the air inlets, and ambient air outside the housing at the opening has a higher air pressure than the air pressure at the air outlet.

8. The centrifugal fan of claim 1, wherein the opening is defined up to the top plate and communicates with the air outlet via the interior of the housing, the bulge contributes to the air outlet having a lower air pressure than the air pressure at each of the air inlets, and ambient air outside housing at the opening has a higher air pressure than the air pressure at the air outlet.

9. A centrifugal fan comprising:

a housing, the housing defining an air inlet, an air outlet, and an opening, a lateral side of the housing forming a bulge close to one end of the air outlet, the bulge extending into an interior of the housing, the opening being adjacent to an opposite end of the air outlet, the housing comprising a base, the base comprising a bottom plate and a sidewall upwardly extending from a periphery of the bottom plate; and an impeller received in the housing, airflow driven by the impeller passing out of the housing via the air outlet;

wherein the opening penetrates through the sidewall of the base and communicates with the external environment of the housing, ambient air external to the housing enters the housing via the opening and flows out of the housing via the air outlet;

wherein the housing further comprises a top plate covering the base, and the top plate connects a top end of the sidewall:

wherein the housing defines another air inlet making a total of two air inlets, one of the air inlets is defined in a center portion of the top plate, and the other air inlet is defined in a corresponding center portion of the bottom plate, with both air inlets corresponding to a position of the impeller;

wherein the bulge is formed on an inner surface of the sidewall close to the other end of the air outlet and extends towards an interior of the housing; and wherein an outer surface of the sidewall forms a protrusion close to the end of the air outlet, the protrusion extends outwards away from the housing, and the opening extends from an outer surface of the protrusion to the inner surface of the sidewall, in a direction towards the air outlet.

10. The centrifugal fan of claim 9, wherein the opening is defined in the sidewall and communicates with the air outlet via the interior of the housing, the bulge contributes to the air outlet having a lower air pressure than the air pressure at each of the air inlets, and ambient air external to the housing has a higher air pressure than the air pressure at the air outlet.

11. The centrifugal fan of claim 9, wherein the opening is defined from the bottom plate and communicates with the air outlet via the interior of the housing, the bulge contributes to the air outlet having a lower air pressure than the air pressure at each of the air inlets, and ambient air external to the housing at the opening has a higher air pressure than the air pressure at the air outlet.

12. The centrifugal fan of claim 9, wherein the opening is defined to the top plate and communicates with the air outlet via the interior of the housing, the bulge contributes to the air outlet having a lower air pressure than the air pressure at each of the air inlets, and ambient air external to the housing at the opening has a higher air pressure than the air pressure at the air outlet.

13. A centrifugal fan comprising:

a housing, the housing comprising a base and a top plate covering the base, the base comprising a bottom plate and a sidewall upwardly extending from a periphery of the bottom plate, the top plate connecting a top end of the sidewall, the housing having an air outlet defined therein, one air inlet defined in a center portion of the top plate, another air inlet defined in a corresponding center portion of the bottom plate, and an opening defined adjacent to an end of the air outlet, the opening penetrating through the sidewall of the base and communicating with the external environment of the housing; and an impeller received in the housing, both the air inlets of the housing being located corresponding to a position of the impeller;

wherein airflow driven by the impeller passes out of the housing via the air outlet, and ambient air external to the housing enters the housing via the opening and flows out of the housing via the air outlet, wherein an inner surface of the sidewall forms a bulge close to an opposite end of the air outlet, the bulge extending towards an interior of the housing; and wherein an outer surface of the sidewall forms a protrusion close to the end of the air outlet, the protrusion extends outwards away from the housing, and the opening extends from an outer surface of the protrusion to the inner surface of the sidewall, in a direction towards the air outlet.

* * * * *